US012427372B2

(12) United States Patent
Yin

(10) Patent No.: US 12,427,372 B2
(45) Date of Patent: Sep. 30, 2025

(54) LEG TRAINING DEVICE

(71) Applicant: Zhong Yin, Zhejiang (CN)

(72) Inventor: Zhong Yin, Zhejiang (CN)

( * ) Notice: Subject to any disclaimer, the term of this patent is extended or adjusted under 35 U.S.C. 154(b) by 0 days.

(21) Appl. No.: 18/955,928

(22) Filed: Nov. 21, 2024

(65) Prior Publication Data

US 2025/0082992 A1 Mar. 13, 2025

(51) Int. Cl.
*A63B 23/04* (2006.01)

(52) U.S. Cl.
CPC ..... *A63B 23/04* (2013.01); *A63B 2208/0233* (2013.01); *A63B 2225/09* (2013.01)

(58) Field of Classification Search
CPC ..... A63B 21/4047; A63B 23/04; A63B 2208/0233
See application file for complete search history.

(56) References Cited

U.S. PATENT DOCUMENTS 2,855,199 A * 10/1958 Noland ..... A63B 21/4047 601/24
4,979,736 A * 12/1990 Maynard ..... A63B 21/0083 482/137
5,088,726 A * 2/1992 Lapcevie ..... A63B 21/155 482/97
5,356,360 A * 10/1994 Johns ..... A63B 21/0628 482/99
6,558,303 B1 * 5/2003 Ellis ..... A63B 23/0494 482/142
6,676,574 B1 * 1/2004 Prokop ..... A63B 23/0494 482/137
7,029,426 B1 * 4/2006 Fuller, Sr. ..... A63B 21/4047 482/137
7,806,815 B2 * 10/2010 Fernandez ..... A63B 21/4047 482/129
8,267,843 B2 * 9/2012 Dellino ..... A63B 21/4047 482/133
10,500,439 B1 * 12/2019 Holman ..... A63B 21/0628
D1,036,577 S * 7/2024 Shen ..... D21/676
2001/0053734 A1 * 12/2001 Lapcevic ..... A63B 21/08 482/137
2004/0058790 A1 * 3/2004 Lapcevic ..... A63B 23/0233 482/130
2004/0254051 A1 * 12/2004 Harrison ..... A63B 23/1281 482/133

(Continued)

OTHER PUBLICATIONS

Lionscool; "https://www.lionscool.com/products/lionscool-leg-extension-and-lying-leg-curl-machine-adjustable-seated-and-prone-lower-body-exercise-bench-in-commercial-grade-cable-operated-plate-loadable-leg-rotation-machine-for-home-garage-gym", Jun. 13, 2024 (Year: 2024).*

(Continued)

*Primary Examiner* — Joshua T Kennedy
(74) *Attorney, Agent, or Firm* — Hawaii Patent Services; Nathaniel K. Fedde; Kenton N. Fedde

(57) ABSTRACT

A leg training device comprises a support frame and a seat installed on the support frame, wherein a leg exercise component and a counterweight bearer are further provided on the support frame, and a load transfer component for transferring a load is provided between the leg exercise component and the counterweight bearer; the load transfer component comprises a connecting element and a guiding element; at least two ends of the connecting element are respectively attached to the leg exercise component and the counterweight bearer.

11 Claims, 6 Drawing Sheets

(56) References Cited

U.S. PATENT DOCUMENTS

| | | | | |
|---|---|---|---|---|
| 2007/0275836 | A1* | 11/2007 | Parviainen ..... | A63B 21/155<br>482/100 |
| 2017/0319905 | A1* | 11/2017 | O'Connor ..... | A63B 21/00181 |

OTHER PUBLICATIONS

Ritfit: "https://www.ritfitsports.com/products/ritfit-plc01-leg-extension-curl-machine"; Sep. 30, 2024 (Year: 2024).*

Altas Strength: "https://altasstrength.com/products/altas-strength-compact-leg-curl-extension-station-al-169"; Sep. 20, 2024 (Year: 2024).*

"Lionscool Leg Extension and Lying Leg Curl Machine, Adjustable Seated and Prone Lower Body Exercise Bench in Commercial Grade, Cable Operated Plate Loadable Leg Rotation Machine for Home Garage Gym" (amazon.com) Published Feb. 22, 2024. Obtained from the internet URL:<https://www.amazon.com/dp/B0CW5GFM8V >. Downloaded on Mar. 17, 2025.

* cited by examiner

A

B

LEG TRAINING DEVICE

TECHNICAL FIELD

The present disclosure relates to the technical field of fitness equipment, in particular to a leg training device.

BACKGROUND

At present, in the field of fitness equipment, kicking machine, as a common lower limb exercise equipment, is widely used in various fitness places and family fitness environments. The traditional kicking machine design usually includes a fixed base, a swinging arm and a roller pad for connecting the leg and the swinging arm. The user's leg strength drives the roller pad, and then drives the swing arm to swing, thus achieving the effect of exercising the lower limb muscles.

The existing U.S. Pat. No. 5,980,434 discloses an "Exercise apparatus with adjustable roller pads". The motion radian of the swing arm of the kicking machine in this patent is mostly arc-shaped, with a swing range roughly ranging from 0° to 90°. Although this design can meet the exercise needs of users to a certain extent, there are some problems in the actual uses.

Specifically, because the trajectory of the swing arm is circular, the weight acting on the leg changes obviously from the beginning to the end. In the initial stage of swinging the swing arm, the weight borne by the leg is relatively light because of the small gravity; however, with the increase of the swing angle of the swing arm, the gravity effect is gradually enhanced, and the weight borne by the leg is also increased.

This uneven distribution of weight from the beginning to the end not only affects the exercise effect of users, but also may pose a potential threat to users' health. Especially in the later stage of swinging arm, due to the sudden increase of weight, the user's leg muscles and joints may bear excessive pressure, thus increasing the risk of injury.

SUMMARY

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

The present disclosure aims to provide a leg training device, which is intended to solve the problem in the prior art that the weight of a kicking machine is unevenly distributed from the beginning to the end.

In order to solve the above technical problem, the object of the present disclosure is achieved through the following technical solution:

The present disclosure provides a leg training device, which includes a support frame and a seat mounted on the support frame; the support frame is further provided with a leg exercise component and a counterweight bearer, and the counterweight bearer is rotatably disposed on the support frame; a load transfer component for transferring a load is provided between the leg exercise component and the counterweight bearer; the load transfer component comprises a connecting element and a guiding element; at least two ends of the connecting element are respectively attached to the leg exercise component and the counterweight bearer; the connecting element bypasses the guiding element, constantly transfers a weight of the counterweight bearer to the leg exercise component, and simultaneously pulls the counterweight bearer to turn over.

The present disclosure further provides a leg training device, which includes a support frame and a seat mounted on the support frame; the support frame is further provided with a leg exercise component and a counterweight bearer, and the counterweight bearer is rotatably provided on the support frame; a load transfer component for transferring a load is provided between the leg exercise component and the counterweight bearer; the load transfer component comprises a rope and a guide wheel; the guide wheel is provided on a support frame, and the rope passes through a wheel groove of the guide wheel and is divided into two parts; the two parts of the rope are respectively attached to the leg exercise component and the counterweight bearer; the two parts of the rope constitute a 1:1 transmission, and the rope is capable of pulling the counterweight bearer to turn over.

The present disclosure provides a leg training device, which includes a support frame and a seat mounted on the support frame; the support frame is further provided with a leg exercise component and a counterweight bearer, and the counterweight bearer is rotatably disposed on the support frame; a load transfer component for transferring a load is provided between the leg exercise component and the counterweight bearer; the load transfer component comprises a pulley transmission mechanism, and the pulley transmission mechanism is used for constantly transferring a load of the counterweight bearer to the leg exercise component; the pulley transmission mechanism is capable of pulling the counterweight bearer to turn over.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

REFERENCE SIGNS

Figure 1:
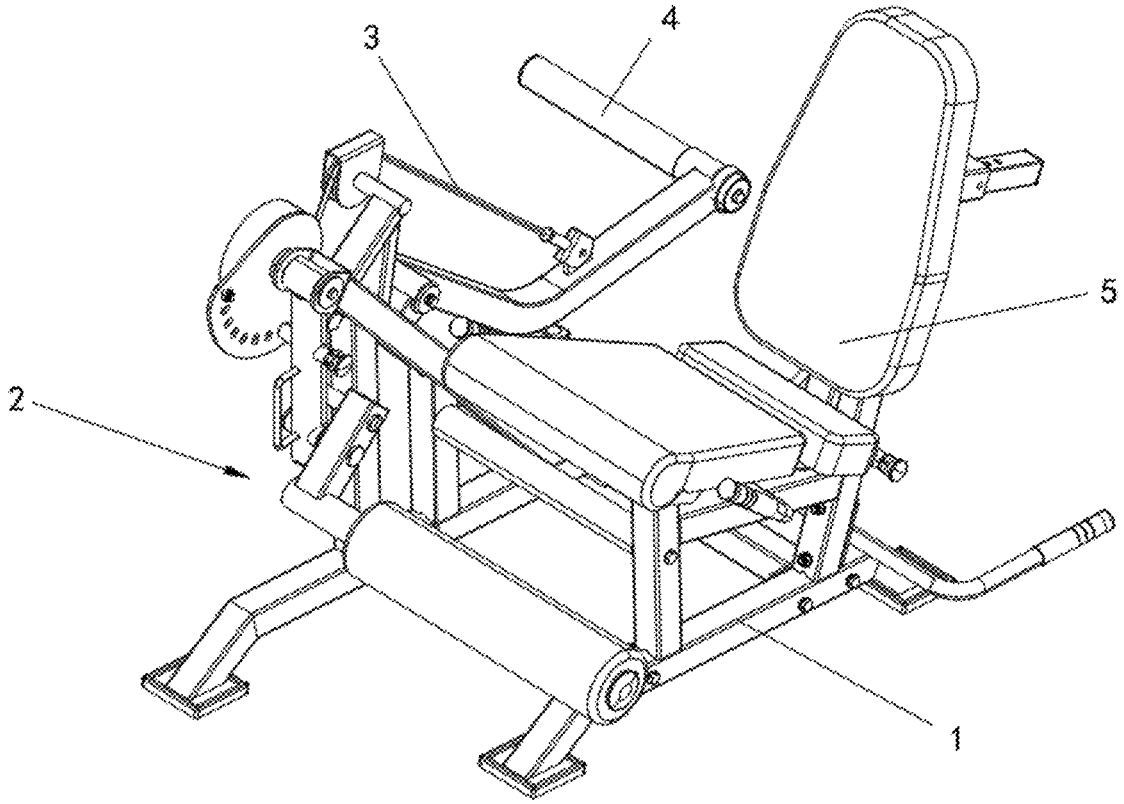
FIG. 1 is a schematic diagram of the overall structure of a leg training device according to an embodiment of the present disclosure.

Support frame (1); Bottom frame (11); Inclined frame (12); Fixed seat (13); Leg exercise component (2); Roller pad (21); Link mechanism (22); First rod (221); Second rod (222); Bolt (223); Adjusting mechanism (23); Adjusting disc (231); Adjusting hole (2311); First bearing (232); Rotating shaft (233); Second bearing (24); Load transfer component (3); Rope (31); Guide wheel (32); Counterweight bearer (4); Rotating rod (41); Mounting rod (42); Seat (5); Seat cushion (51); Back cushion (52).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIG. 1 to FIG. 6, an embodiment of the present disclosure provides a leg training device, which includes a support frame 1, a seat 5, a leg exercise component 2, a load transfer component 3 and a counterweight bearer 4. The seat 5 is provided on the support frame 1, the leg exercise component 2 is rotatably connected to the support frame 1 and located at the front side of the seat 5, and the counterweight bearer 4 is rotatably provided on the support frame 1. One end of the load transfer component 3 is connected to the counterweight bearer 4, and the other end of the load transfer component 3 is connected to the leg exercise component 2.

In this embodiment, when the user sits on the seat 5, the user lifts up the leg exercise component 2 by his legs, and the leg exercise component 2 drives the load transfer component 3, which then drives the counterweight bearer 4. A counterweight (not shown) is placed on the counterweight bearer 4. With this configuration, when the user lifts the leg exercise component 2, the counterweight bearer 4 can provide stable resistance to the leg exercise component 2 through the load transfer component 3, so as to achieve the purpose of exercising the leg muscles of the user.

The counterweight bearer 4 includes a rotating rod 41 and a mounting rod 42. One end of the rotating rod 41 is rotatably provided on the support frame 1, and the mounting rod 42 is connected to the other end of the rotating rod 41. The counterweight is a dumbbell plate, which can be sleeved on the mounting rod 42 to provide resistance to the leg exercise component 2. If a user needs a heavier weight, a plurality of counterweight blocks can be sleeved on the mounting rod 42.

It can be appreciated that the present application transfers the resistance of the counterweight bearer 4 to the leg exercise component 2 through the load transfer component 3, thus facilitating the balanced and smooth lifting of the leg exercise component 2, realizing the balanced transfer of the weight of the leg exercise component 2 from the beginning to the end, improving the user's experience and avoiding the user from being injured due to the sudden increase in weight.

Figure 2:
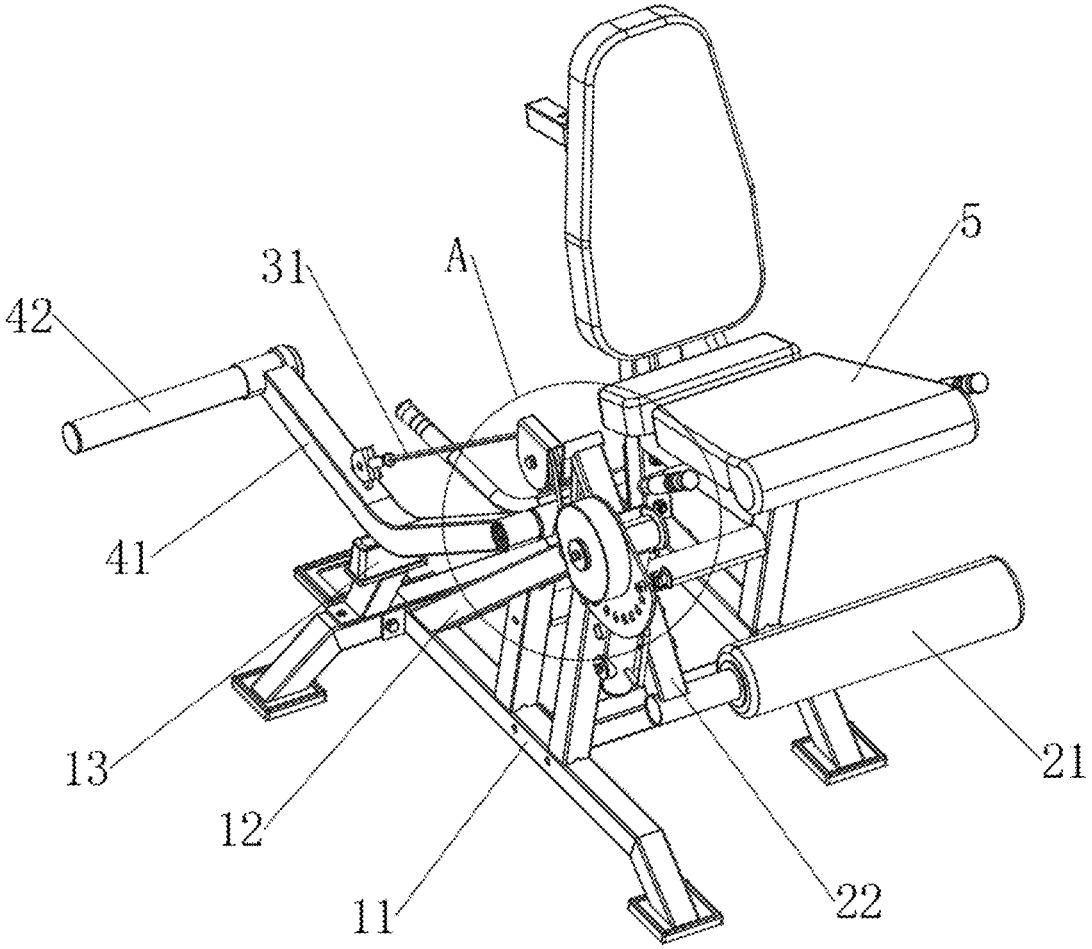
FIG. 2 is a schematic structural view from another perspective of FIG. 1.

Next, the specific structure of the leg exercise module 2 will be described in detail:

As shown in FIG. 2, in one embodiment, the leg exercise component 2 includes a roller pad 21, a link mechanism 22 and an adjusting mechanism 23. Both of the link mechanism 22 and the adjusting mechanism 23 are rotatably disposed on the support frame 1. The link mechanism 22 is detachably connected to the adjusting mechanism 23, the roller pad 21 is in connected to the link mechanism 22 and located at the front side of the seat 5, and the load transfer component 3 is fixedly connected to the adjusting mechanism 23.

In this embodiment, after the user sits on the seat 5, the user puts his legs on the bottom of the roller pad 21. The roller pad 21 is connected to the link mechanism 22, so that the roller pad 21 can rotate through the link mechanism 22. As such, the user can lift the roller pad 21 forcibly, and the link mechanism 22 can simultaneously link the adjusting mechanism 23 to rotate, while the adjusting mechanism 23 rotates and pulls the load transfer component 3, and the load transfer component 3 is rotated and lifted with a linkage with the counterweight bearer 4 to provide resistance to the roller pad 21.

Figure 3:
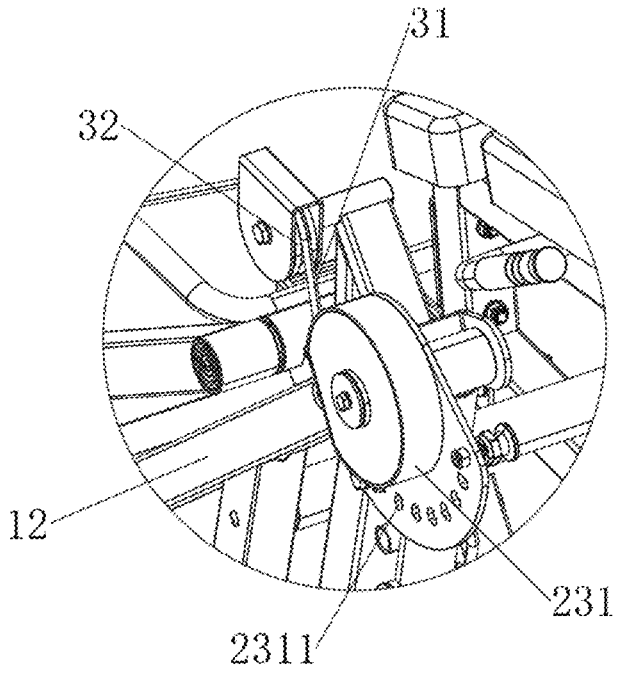
FIG. 3 is a partially enlarged schematic view at A of FIG. 2.
Figure 4:
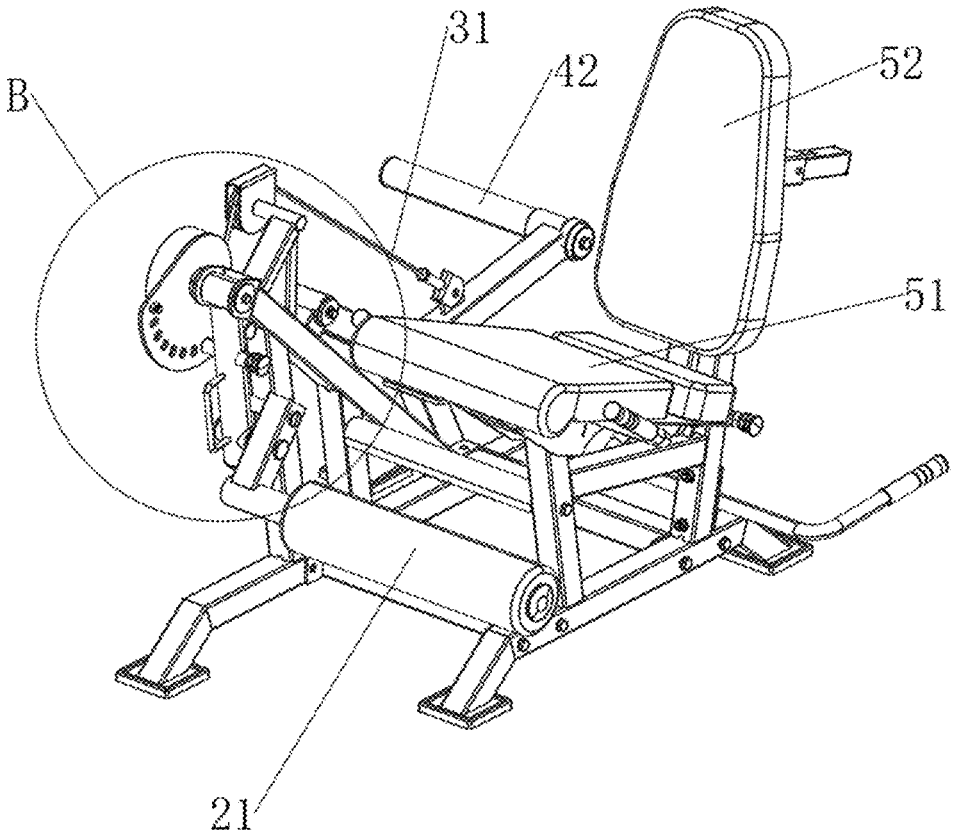
FIG. 4 is a schematic structural view from another perspective of FIG. 2.
Figure 5:
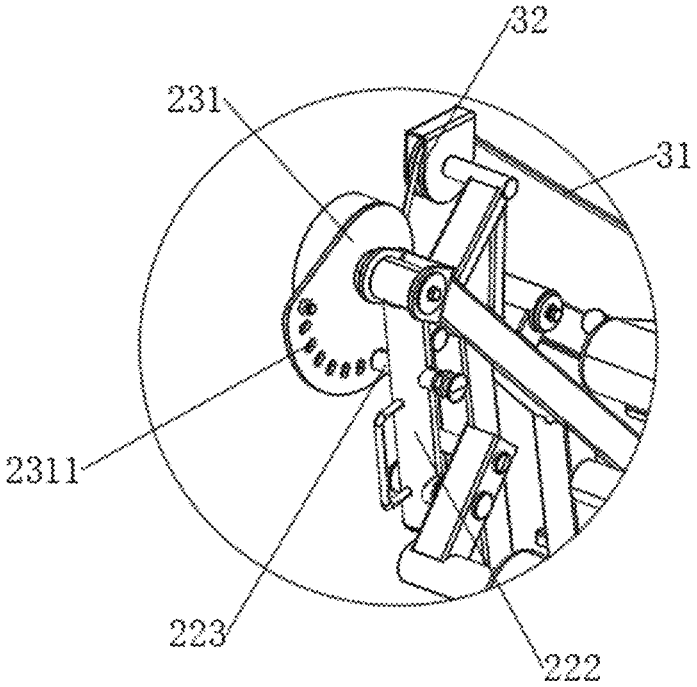
FIG. 5 is a partially enlarged schematic view at B of FIG. 4.
Figure 6:
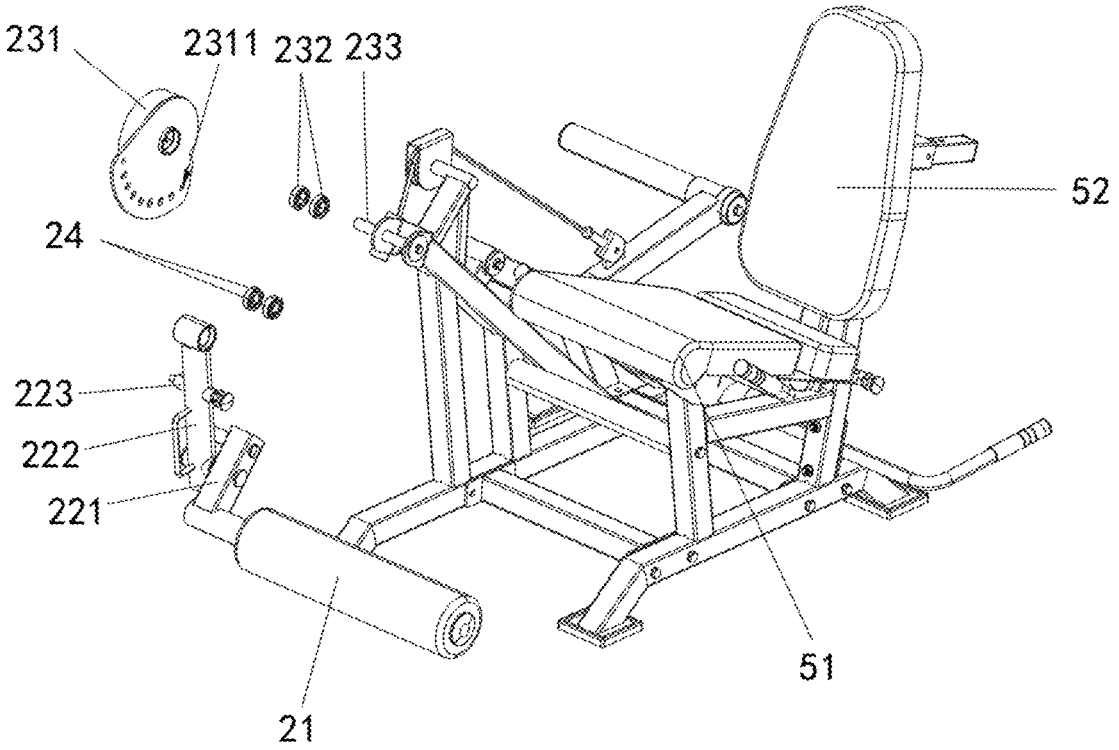
FIG. 6 is an exploded view of FIG. 1.

As shown in FIG. 3, in one embodiment, the adjusting mechanism 23 includes an adjusting disc 231, a rotating shaft 233 and a plurality of first bearings 232. The rotating shaft 233 is connected to the support frame 1, and the plurality of first bearings 232 are sleeved on the rotating shaft 233. The adjusting disc 231 is sleeved on the plurality of first bearings 232, the link mechanism 22 is detachably connected to the adjusting disc 231, and the load transfer component 3 is fixedly connected to the adjusting disc 231.

In this embodiment, when the user sits on the seat 5 and lifts up the leg exercise module 2 with both legs, the roller pad 21 and the link mechanism 22 will move upward. Because the link mechanism 22 is detachably connected with the adjusting disc 231, when the link mechanism 22 moves upward, the adjusting disc 231 will be driven to rotate on the rotating shaft 233. The rotation of the adjusting disc 231 will further pull the load transfer component 3 fixedly connected therewith. The other end of the load transfer component 3 is connected with the counterweight bearer 4, therefore when the load transfer component 3 is pulled, the counterweight bearer 4 will also be pulled and move with it. The counterweight on the counterweight bearer 4 provides resistance for the user, and this resistance is transmitted to the user's leg through the load transfer component 3 and the adjusting mechanism 23, thus realizing the exercise of leg muscles.

In an embodiment, a plurality of second bearings 24 are sleeved on the rotating shaft 233, and the link mechanism 22 is sleeved on the plurality of second bearings 24.

In this embodiment, the link mechanism 22 is sleeved on the rotating shaft 233 through a plurality of second bearings 24, so that the link mechanism 22 and the rotating shaft 233 of the adjusting mechanism 23 have the same axis, thereby the link mechanism 22 drives the adjusting mechanism 23 to rotate more stably.

In an embodiment, the link mechanism 22 includes a first rod 221, a second rod 222 and a bolt 223. The roller pad 21 is connected to the first rod 221, the first rod 221 is connected to the second rod 222, the second rod 222 is sleeved on a plurality of second bearings 24, and the bolt 223 penetrates the second rod 222 and is inserted into the adjusting disc 231.

In this embodiment, when the user sits on the seat 5 and lifts the leg exercise component 2 upward by the leg force, the roller pad 21 and the first rod 221 will move upward accordingly. Because the first rod 221 is connected with the second rod 222, the force exerted on the roller pad 21 and the first rod 221 is transmitted to the second rod 222, so that the second rod 222 (and the second bearings 24 sleeved on it) rotates around the axis of the rotating shaft 233, thereby realizing the lifting and rotation of the roller pad 21. The arrangement of the bolt 223 ensures that the link mechanism 22 will not fall off the adjusting disc 231 during the rotation, which is beneficial to the stability of the link mechanism 22 driving the adjusting mechanism 23 to rotate.

In an embodiment, the adjusting disc 231 is provided with a plurality of spaced adjusting holes 2311, and the bolt 223 can be inserted into any of the adjusting holes 2311.

In this embodiment, the adjusting holes 2311 are provided around the rotating shaft 233 of the adjusting disc 231. Since the link mechanism 22 and the rotating shaft 233 of the adjusting disc 231 also have the same axis, each adjusting hole 2311 is on the rotating track of the link mechanism 22. Therefore, when the bolt 223 is inserted into different adjusting holes 2311, the starting angle of the link mechanism 22 varies, that is, the starting angle of the roller pad 21 is changed, thereby meeting the different intensities of leg training of users.

In an embodiment, the load transfer component 3 includes a rope 31 and a guide wheel 32. The guide wheel 32 is provided on the support frame 1, and the rope 31 is wound around the guide wheel 32. One end of the rope 31 is connected to the counterweight bearer 4, and the other end of the rope 31 is connected to the leg exercise component 2.

In this embodiment, the rope 31 is tightly wound around the guide wheel 32, and the power and movement are transmitted by friction. When the adjusting mechanism 23 rotates, it will pull the rope 31 to move on the guide wheel 32, and the guide wheel 32 can provide support and guide the movement of the rope 31, ensure that the rope 31 keeps the correct path and tension in the transmission process, and avoid the rope 31 from loosening or excessive wear.

And a fixed pulley transmission mechanism is formed between the rope 31 and the guide wheel 32, so that the stress on the two parts of the rope 31 at both sides of the guide wheel 32 is 1:1, thus ensuring that the weight of the counterweight bearer 4 is always and constantly transferred to the leg exercise component 2, thus avoiding the influence of gravity change on the exercise effect and improving the user experience.

In this embodiment, the number of guide wheels 32 is one, but in other possible embodiments (not shown in the figure), the number of guide wheels 32 may be multiple, thus forming a fixed pulley block, further improving the moving convenience of the rope 31.

In one embodiment, the support frame 1 is provided with a fixed seat 13, and the counterweight bearer 4 can be supported on the fixed seat 13.

In this embodiment, when the load transfer component 3 does not pull the counterweight bearer 4, the counterweight bearer 4 is supported on the fixed seat 13, and when the load transfer component 3 pulls the counterweight bearer 4 to rotate, the counterweight bearer 4 is separated from the fixed seat 13. In this way, when the load transfer component 3 does not pull the counterweight bearer 4, the counterweight bearer 4 is stably supported on the fixed seat 13. Therefore, the counterweight bearer 4 can be prevented from shaking or tilting when it is not stressed, and ensure the static stability of the leg training device.

In one embodiment, the support frame 1 includes a bottom frame 11 and an inclined frame 12, which is obliquely provided on the bottom frame 11. The leg exercise component 2, the load transfer component 3 and the counterweight bearer 4 are all provided at the top end of the inclined frame 12.

In this embodiment, the support frame 1 consists of a bottom frame 11 and an inclined frame 12. The bottom frame 11 serves as a solid foundation of the whole structure and provides necessary supporting force. The inclined frame 12 is obliquely provided on the bottom frame 11 to form an upward inclined surface. With this configuration, the spatial layout and stress situation of the whole leg training device can be optimized. At the top end of the inclined frame 12 in the inclined direction, there are three key components, namely the leg exercise component 2, the load transfer component 3 and the counterweight bearer 4. The leg exercise component 2 enables the counterweight bearer 4 to rotate smoothly along the inclined frame 12 under the pull of the load transfer component 3, thus ensuring the fluency and stability of the movement. The rope 31 is wound around the guide wheel 32, with one end connected to the counterweight bearer 4 and the other end connected to the leg exercise component 2, and the rotation of the counterweight bearer 4 is realized through the transmission of the rope 31. The counterweight bearer 4 is directly placed on the fixed seat 13 at the top end of the inclined frame 12, and remains stable when the rope 31 is not pulled. When the rope 31 is pulled, the counterweight bearer 4 is separated from the fixed seat 13 and starts to rotate along the inclined frame 12. This configuration not only ensures the compact structure and reasonable stress of the leg training device, but also greatly improves the convenience and safety of use.

In one embodiment, the seat 5 includes a seat cushion 51 and a back cushion 52, one side of which is rotatably provided on the support frame 1, and the seat cushion 51 is connected to the other side of the back cushion 52.

In this embodiment, the seat cushion 51 is a plane part that the user directly contacts when sitting, providing a comfortable sitting feeling. The back cushion 52 is a component on the back of the seat 5 to support the back of the user. One side of the back cushion 52 is provided on the support frame 1 in a rotatable connection manner, so that the angle of the back cushion 52 can be adjusted within a certain range to meet the needs of different users for the back support angle.

The leg training device provided by the present disclosure has high safety. When a user lifts the roller pad 21 by his legs, the roller pad 21 transfers the resistance of the counterweight bearer 4 through the load transfer component 3, so that the weight of the roller pad 21 is constant in the process of being lifted from the bottom to the top, and there will be no sudden increase in the weight of the roller pad 21 during lifting, thus ensuring the safety of the user during training and avoiding muscle strain of the user.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A leg training device comprising a support frame and a seat mounted on the support frame, wherein the support frame is further provided with a leg exercise component and a counterweight bearer, and the counterweight bearer is rotatably disposed on the support frame; and a load transfer component for transferring a load is provided between the leg exercise component and the counterweight bearer;

the load transfer component comprises a connecting element and a guiding element;

at least two ends of the connecting element are respectively attached to the leg exercise component and the counterweight bearer;

the connecting element bypasses the guiding element, and is configured to constantly transfer a weight of the counterweight bearer to the leg exercise component, and simultaneously pull the counterweight bearer to turn over; and the leg exercise component comprises a roller pad sleeved on a roller pad rod, a link mechanism, and an adjusting mechanism, and both the link mechanism and the adjusting mechanism are rotatably disposed on the support frame;

wherein the link mechanism comprises a first rod, a second rod and a bolt;

wherein the adjusting mechanism comprises an adjusting disk and a rotating shaft;

wherein one end of the first rod is connected to the roller pad rod and another end is pivotally connected to one end of the second rod; and wherein the bolt is configured to connect the second rod to the adjusting disk.

2. The leg training device according to claim 1, wherein the link mechanism is detachably connected to the adjusting mechanism, the roller pad is connected to the link mechanism and located at a front side of the seat, and one end of the connecting element is fixedly connected to the adjusting mechanism.

3. The leg training device according to claim 2, wherein the adjusting mechanism further comprises a plurality of first bearings, wherein the rotating shaft is connected to the support frame, the plurality of first bearings are sleeved on the rotating shaft, and the adjusting disc is sleeved on the plurality of first bearings.

4. The leg training device according to claim 3, wherein the link mechanism is detachably connected to the adjusting disc, and the load transfer component is fixedly connected to the adjusting disc.

5. The leg training device according to claim 4, wherein a plurality of second bearings are sleeved on the rotating shaft, and the link mechanism is sleeved on the plurality of second bearings.

6. The leg training device according to claim 5, wherein the second rod is sleeved on the plurality of second bearings, and the bolt penetrates the second rod and is inserted into the adjusting disc.

7. The leg training device according to claim 6, wherein the adjusting disc is provided with a plurality of spaced adjusting holes, and the bolt is insertable into any of the adjusting holes.

8. The leg training device according to claim 1, wherein the connecting element is a rope, and the guiding element is a guide wheel; the guide wheel is provided on the support frame, and the rope is wound around the guide wheel; one end of the rope is connected to the counterweight bearer, and the other end of the rope is connected to the leg exercise component.

9. The leg training device according claim 1, wherein another end of the second rod is connected to the rotating shaft.

10. A leg training device, comprising a support frame and a seat mounted on the support frame, wherein the support frame is further provided with a leg exercise component and a counterweight bearer, and the counterweight bearer is rotatably provided on the support frame; and a load transfer component for transferring a load is provided between the leg exercise component and the counterweight bearer;

the load transfer component comprises a rope and a guide wheel;

the guide wheel is provided on a support frame, and the rope passes through a wheel groove of the guide wheel and is divided into two parts; and the two parts of the rope are respectively attached to the leg exercise component and the counterweight bearer; and wherein the support frame is provided with a fixed seat, and the counterweight bearer is oriented to be supported on the fixed seat;

the two parts of the rope constitute a 1:1 transmission, and the rope is configured for pulling the counterweight bearer away from the fixed seat to turn over.

11. The leg training device according to claim 10, wherein the support frame comprises a bottom frame and an inclined frame; the inclined frame is obliquely provided on the bottom frame, and the leg exercise component, the load transfer component and the counterweight bearer are all provided at a top end of the inclined frame.

* * * * *